US005188024A

United States Patent [19]

Li

[11] Patent Number: 5,188,024

[45] Date of Patent: Feb. 23, 1993

[54] CAN CRUSHER

[76] Inventor: Liang-Kun Li, c/o Hung Hsing Patent Service Center P.O. Box 55-1670, Taipei (10477), Taiwan

[21] Appl. No.: 817,322

[22] Filed: Jan. 6, 1992

[51] Int. Cl.[5] ..... B30B 9/32; B30B 1/04

[52] U.S. Cl. ..... 100/274; 100/902

[58] Field of Search ..... 100/266, 274, 902

[56] References Cited

U.S. PATENT DOCUMENTS

| | | | |
|---|---|---|---|
| 236,253 | 1/1881 | Phares | 100/274 X |
| 1,192,343 | 7/1916 | Penn | 100/274 X |
| 2,191,488 | 2/1940 | McCowan | 100/274 X |
| 2,200,515 | 5/1940 | Moeller | 100/274 X |
| 3,941,049 | 3/1976 | Britt | 100/274 |
| 4,148,255 | 4/1979 | McQueen | 100/274 X |
| 4,213,387 | 7/1980 | McCaney et al. | 100/902 X |

FOREIGN PATENT DOCUMENTS

| | | | |
|---|---|---|---|
| 823675 | 12/1951 | Fed. Rep. of Germany | 100/274 |

*Primary Examiner*—Stephen F. Gerrity

[57] ABSTRACT

A can crusher includes a ratchet bar having a plurality of ratchet teeth longitudinally formed on the bar and having a piston member secured on a front end portion of the bar reciprocatively held in a squeezing chamber formed in a base of the can crusher, a lever pivotally secured to a driving box secured on a rear portion of the base having a first pawl pivotally mounted on a lower end portion of the lever engageable with the ratchet teeth on the ratchet bar, a second pawl pivotally formed on the driving box for preventing a rearward retraction of the ratchet bar, whereby upon an upward pulling of the lever, the first pawl will urge a ratchet tooth of the ratchet bar forwardly to squeeze a can inserted in between the piston member and a compression end plate secured on the base, thereby gradually intermittently pushing the piston member forwardly for crushing the can with a lighter force.

3 Claims, 5 Drawing Sheets

CAN CRUSHER

BACKGROUND OF THE INVENTION

A conventional can crusher includes: a piston pivotally connected with a lever handle for a reciprocatively sliding movement in a recess chamber formed in a housing mounted on an elongated base member whereby upon a pulling of the handle to move the piston forwardly in the housing chamber, an aluminum can inserted in the chamber will be squeezed by the piston for minimizing the volume of the can for convenient disposal.

However, such a conventional can crusher may have the following drawbacks:

1. when pulling the handle to move the piston for squeezing the can, a counter force will be exerted from the can under compression as it is impacted by the piston and such a counter force will be fed back to the operator's hand gripping the handle to partially counteract the compression force produced by the handle, thereby requiring greater force for crushing a can; and 2. since a portable can crusher is generally used by a family for compacting and treating a beverage can drunk by the family, the can crusher should be designed to be easily and lightly operated, even convenient for a woman or a child. The conventional portable can crusher is operated heavily and is not suitable for a woman or child's operation.

The present inventor has found the drawbacks of a conventional can crusher and has invented the present can crusher to be lightly operated.

SUMMARY OF THE INVENTION

The object of the present invention is to provide a can crusher including; a ratchet bar having a plurality of ratchet teeth longitudinally formed on the bar and having a piston member secured on a front end portion of the bar reciprocatively held in a squeezing chamber formed in a base of the can crusher, a lever pivotally secured to a driving box secured on a rear portion of the base having a first pawl pivotally mounted on a lower end portion of the lever engageable with the ratchet teeth on the ratchet bar, a second pawl pivotally formed on the driving box for preventing a rearward retraction of the ratchet bar, whereby upon an upward pulling of the lever, the first pawl will urge a ratchet tooth of the ratchet bar forwardly to squeeze a can inserted in between the piston member and a compression end plate secured on the base, thereby gradually intermittently pushing the piston member forwardly for crushing the can with a lighter force.

DETAILED DESCRIPTION

Figure 1:
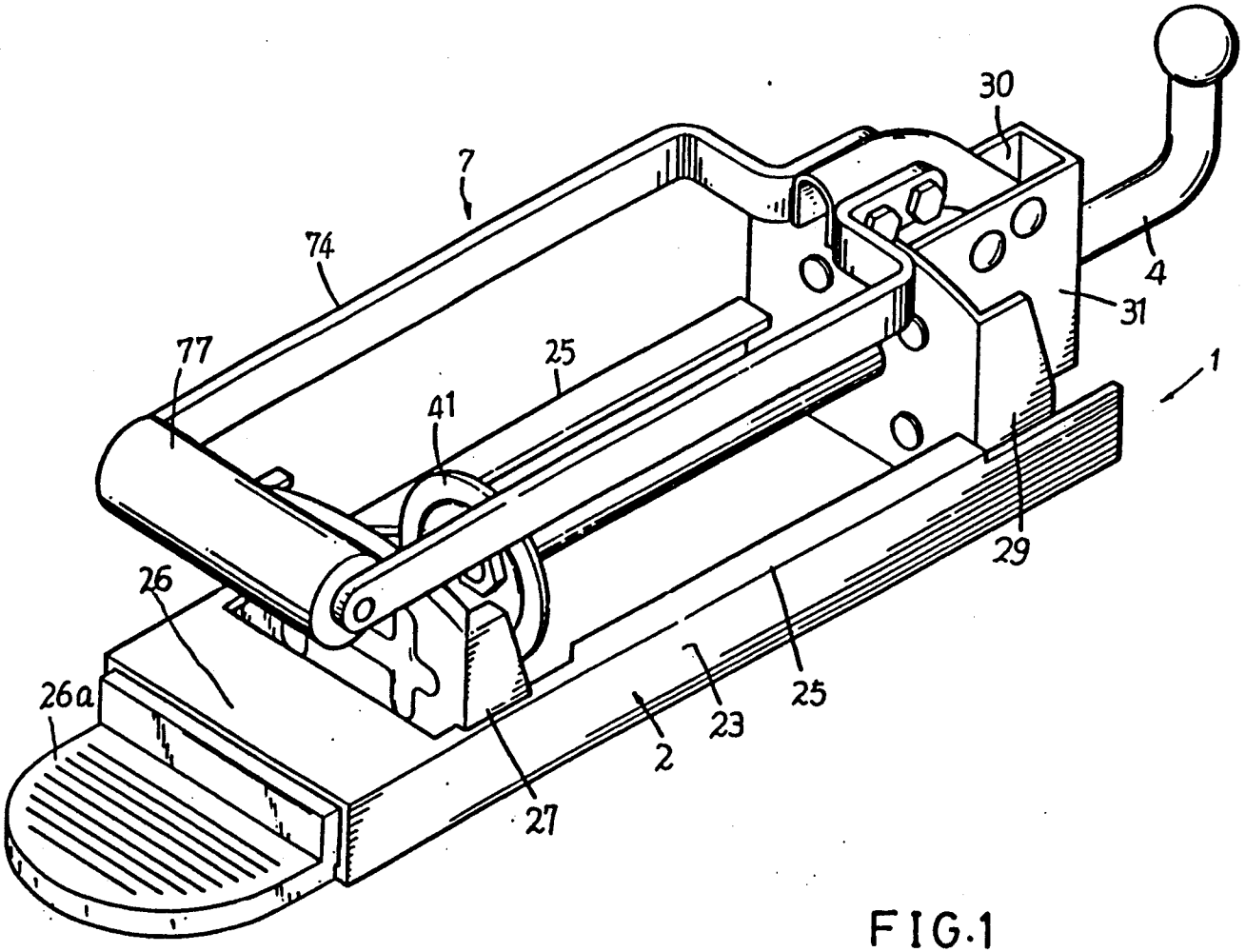
FIG. 1 is a perspective view of the present invention.
Figure 2:
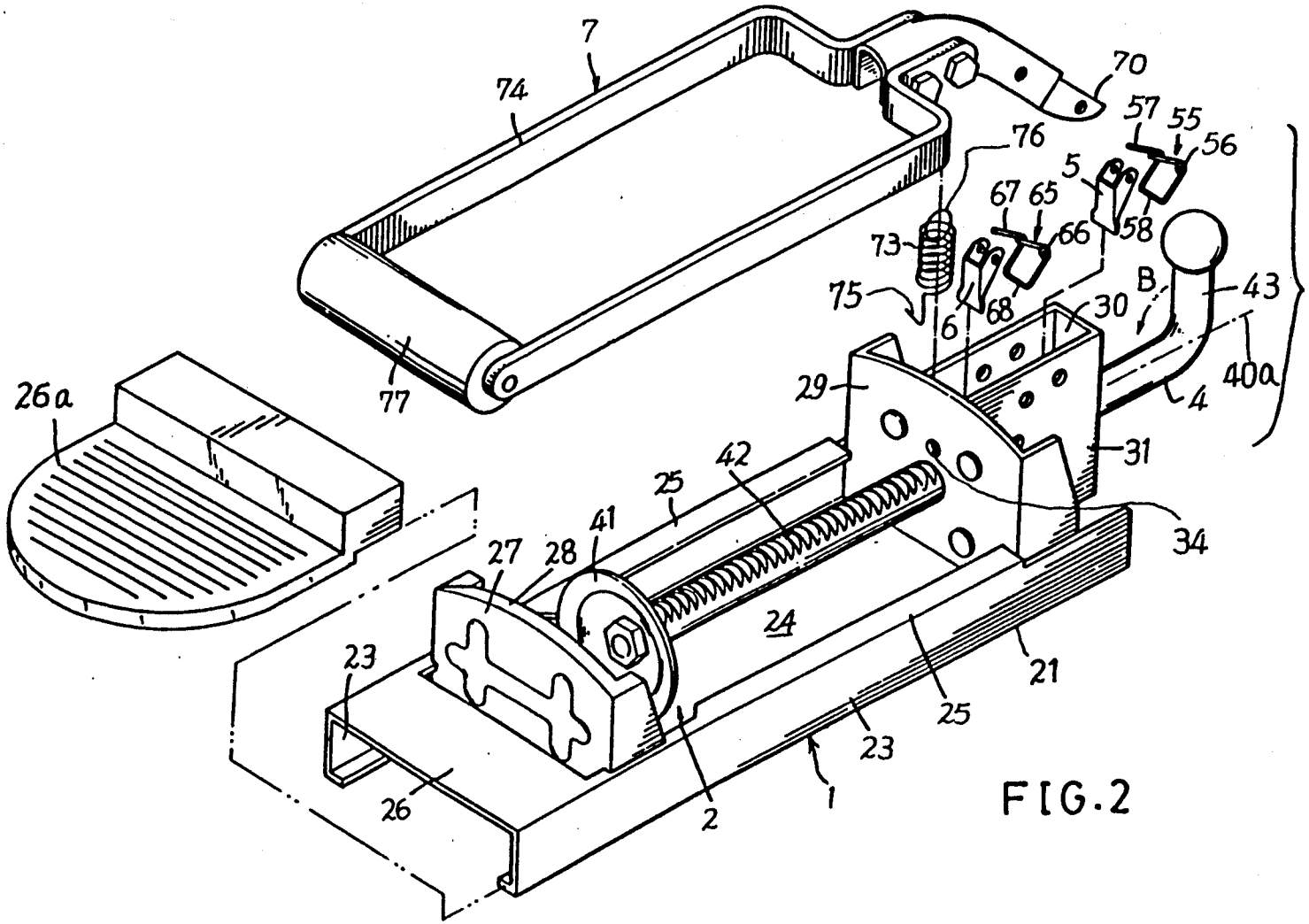
FIG. 2 is an illustration showing all elements of construction of the present invention.
Figure 3:
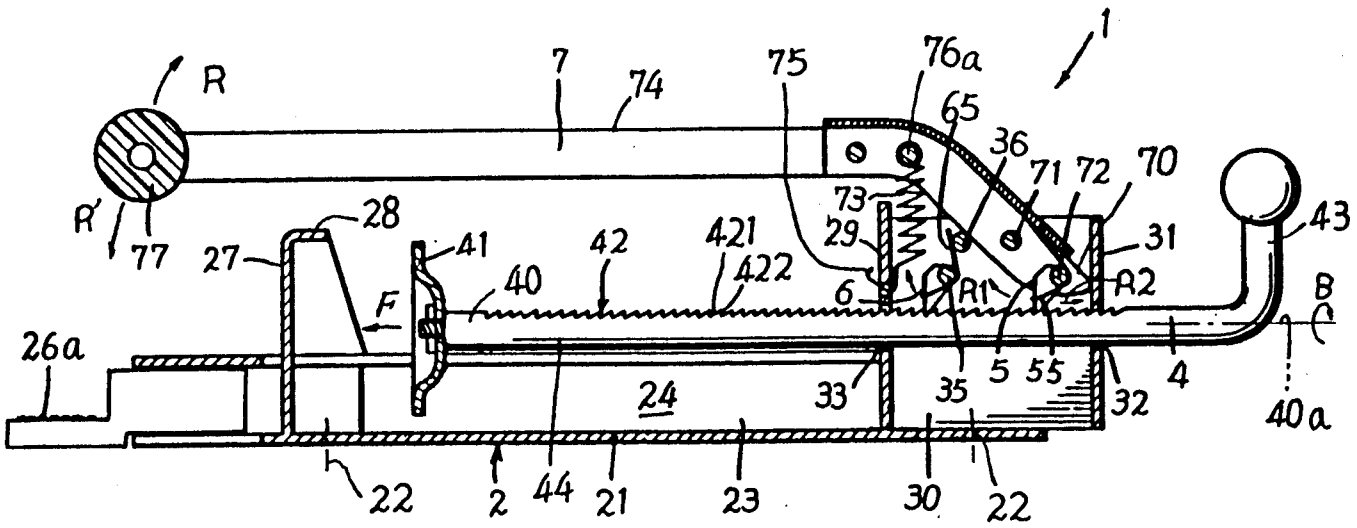
FIG. 3 is a sectional view of the present invention.

As shown in FIGS. 1-3, a can crusher 1 of the present invention comprises: a base means 2, a driving box means 3, a squeezing means 4, a first pawl 5, a second pawl 6, and a lever means 7.

The base means 2 includes a bottom plate 21 generally formed as a rectangular shape having a plurality of fixing holes 22 formed in the bottom plate 21 for fixing the base means 2 on a wall or on a table surface by screws of bolts (not shown), a pair of longitudinal side walls 23 longitudinally formed on two opposite sides of the bottom plate 21 protruding upwardly from the bottom plate 21 having an upper edge portion 25 bent inwardly from each side wall 23, a holding plate portion 26 secured with a holding platform 26*a* formed on a first end portion of the bottom plate 21, a compression end plate 27 formed on a first end portion of the bottom plate 21 perpendicular to the bottom plate 21 and adjacent to the holding platform 26*a* having an upper extension 28 bent downwardly towards a second end portion of the bottom plate 21 for retaining a can C inserted in the base means 2, a retraction end plate 29 formed on a second end portion of the bottom plate 21 opposite to the compression end plate 27 and perpendicular to the bottom plate 21, and a squeezing chamber 24 defined by the bottom plate 21, the two side walls 23, the compression end plate 27 and the retraction end plate 29.

When the base means 2 is not fixed on a wall or on a surface, the can crusher can then be portable.

The squeezing chamber 24 should be large enough for inserting the can C either 500 cc or 350 cc, but not limited for its size.

The driving box means 3 includes a box casing 31 secured on a second end portion of the bottom plate 21 and secured with the retraction end plate 29 having a socket 30 recessed in the casing 31, and a pair of bar holes 32, 33 longitudinally formed through the casing 31.

The squeezing means 4 includes: a ratchet bar 40, having a plurality of ratchet teeth 42 longitudinally formed on the bar 40 having a cylindrical surface 44 formed on the bar 40 reciprocatively engageable with the two bar holes 32, 33 formed in the driving box means 3 and having a longitudinal bar axis 40*a* formed in a longitudinal center of the bar 40 perpendicular to the retraction end plate 29 and the compression end plate 27 respectively, a piston member 41 secured on a first end portion of the bar 40 and perpendicular to the bar 40 for operatively squeezing a can C inserted between the piston member 41 and the compression end plate 27, and a ratchet-bar handle 43 formed on a second end portion of the bar 40 opposite to the piston member 41.

The ratchet bar 40 includes the ratchet teeth 42 longitudinally formed on a cylindrical surface portion 44 of the bar with each ratchet tooth 42 disposed on a partial perimeter of the bar 40, less than one half of the perimeter of the bar 40 from a cross sectional view of the bar, each ratchet tooth 42 is recessed in the bar 40 to form a triangular tooth 421 tapered upwardly rearwardly towards the second end portion of the bottom plate 21 and an angled recess 422 following each triangular tooth 421, thereby allowing a single-direction forward movement of the bar 40 towards the compression end plate 27 as engageably urged by the first pawl 5 and the second pawl 6, and preventing a retraction of the bar 40 as retarded by the pawls 6, 5.

The first pawl 5 is pivotally secured to a lowermost portion 70 of the lever means 7 by a first-pawl pin 72 fixed on the lever means 7 and normally restored downwardly for engaging the ratchet teeth 42 of the ratchet bar 40 by a first-pawl restoring spring 55 which includes a pair of loop portions 56 formed on a middle portion of the first-pawl spring 55 jacketed on the first-pawl pin 72, an upper spring end portion 57 retained on the lowesmost portion 70 of the lever means 7, and a lower spring end portion 58 restoring the first pawl 5 downwardly to be engaged with the ratchet teeth 42.

The second pawl 6 is pivotally mounted on the box casing 31 of the driving box means 3 by a second-pawl pin 35 secured on the box casing 31 in front of the first pawl 5 as shown in FIG. 3 and normally restored downwardly for engaging the ratchet teeth 42 of the ratchet bar 40 by a second-pawl spring 65 which includes a pair of loop portions 66 formed on a middle portion of the second-pawl spring 65 jacketed on the second-pawl pin 35, an upper spring end portion 67 retained on a retaining pin 36 transversely secured on an upper portion of the box casing 31, and a lower spring end portion 68 restoring the second pawl 6 downwardly to be engaged with the ratchet teeth 42.

The lever means 7 includes a pivot 71 fixed on the box casing 31 for pivotally securing a lower portion of the lever means 7 on the box casing 31 of the driving box means 3, a first-pawl pin 72 fixed on a lowermost portion 70 of the lever means 7 for pivotally securing the first pawl 5 on the first-pawl pin 72, a lever restoring spring 73 having a lower spring end 75 secured to a retaining hole 34 formed in the retraction end plate 29 and having an upper spring end 76 secured on a spring retaining pin **76*a* secured on the lever means 7 above the pivot 71 of the lever means 7 for normally tensioning the lever means 7 downwardly towards the base means 2 ready for an upward pulling operation of the lever means 7, and a bifurcate arm member 74 protruding outwardly from the lower portion of the lever means 7 having a grip 77 provided with elastomer packing on the grip 77 secured on an outer end portion of the arm member 74**.

Figure 4:
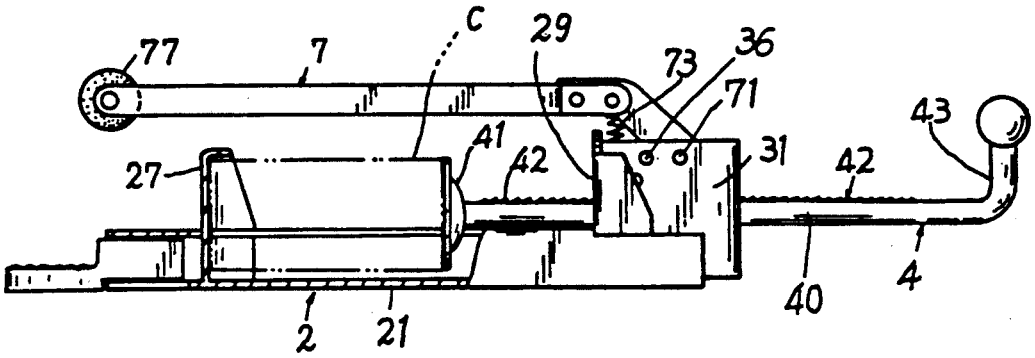
FIG. 4 shows a first operational step for crushing a can in accordance with the present invention.
Figure 5:
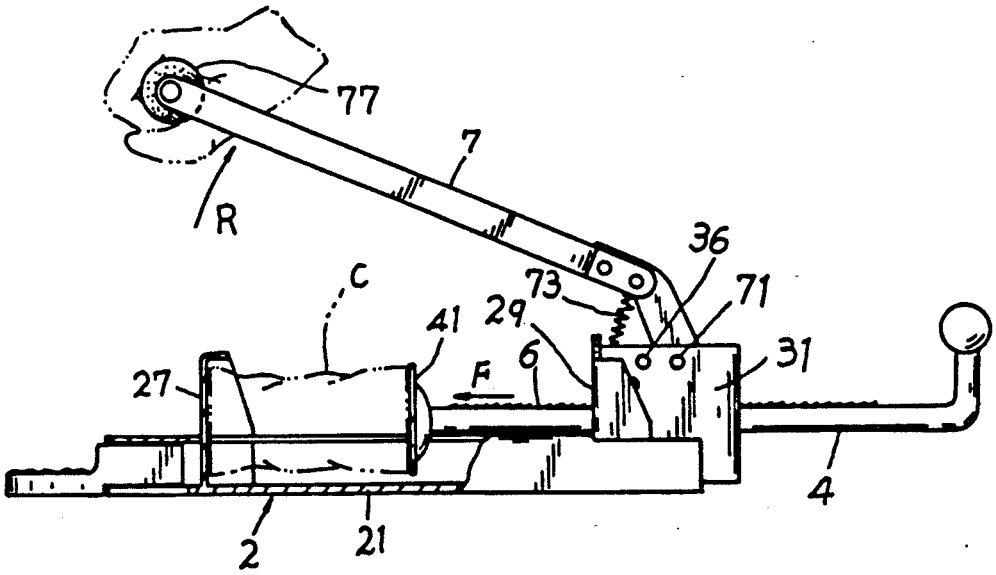
FIG. 5 shows a second step for crushing the can.

For crushing a can such as an aluminum beverage can C as shown in FIGS. 4, 5, the can C is inserted between the piston member 41 and the compression end plate 27 of the base means 2 and the lever means 7 is pulled upwardly in direction R (FIG. 5) to allow the first pawl 5 to urge the ratchet tooth 42 of the ratchet bar 40 frontwardly with a small step to push the piston 41 to squeeze the can C primarily (direction F). Then, the lever means 7 is depressed downwardly in direction R' as shown in FIG. 3 to allow the first pawl 5 to be slipped away from the ratchet teeth 42 in direction R1 (FIG. 3). The pawl 5 will be normally restored to always engage the ratchet tooth 42 ready for the next pulling action of the lever means 7. Further pulling of the lever means 7 upwardly to repeat the aforesaid cycle, the first pawl 5, which is retarded by the ratchet tooth 42 and will not be rotated counter-clockwise (R2 as shown in FIG. 3), will urge the ratchet tooth 42 and the bar 40 frontwardly towards the compression end plate 27 for secondarily squeezing, compacting or crushing the can C furthermore.

Therefore, after repeated pulling and depression of the lever means 7, the piston 41 will be intermittently pushed forwardly for gradually squeezing or crushing the can to a minimum volume, convenient for disposal purposes for enhancing environmental protection.

Figure 6:
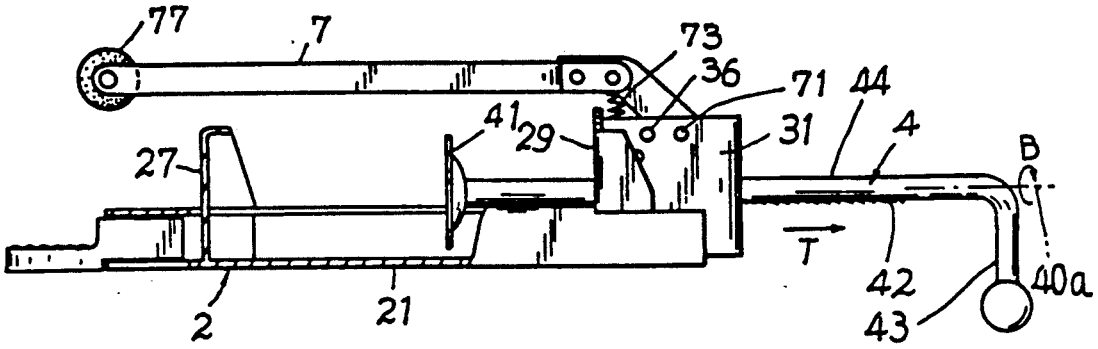
FIG. 6 shows a retraction of the ratchet bar in accordance with the present invention.

When the piston member 41 reaches its forwardmost limit to almost touch the compression end plate 27, the handle 43 of the squeezing means 4 is rotated downwardly, for example, 180 degrees about the axis **40*a* in direction B as shown in FIG. 6, and then pulled rearwardly (direction T) to retract the piston member 41 and the bar 40 until being limited by the retraction end plate 29. Since the ratchet teeth 42 are disengaged from the pawls 5, 6 so that the bar 40 can be retracted rearwardly as shown in FIG. 6**.

The holding platform **26*a* may be depressed by an operator's hand or foot so that the operator's other hand may pull the lever means 7 for crushing the can. The bottom plate 21** may also be vertically mounted on a wall (not shown) for a vertically reciprocative crushing movement.

The present invention is superior to a conventional can crusher with the following advantages:

1. the crushing operation is intermittently done for preventing a heavy immediate squeezing operation as required for operating a conventional can crusher;

2. the pawls 6, 5 are provided to prevent the retraction of the bar 40 so that any counter force produced from the can under crushing will not be directly transmitted back to the operator's hand for partially saving a thrusting force of the lever 7 for easily lightly operating the present crusher; and 3. since it is operated lightly, even a child or a woman may easily operate the can crusher.

I claim:

1. A can crusher comprising:

a base including a bottom plate defining a first end portion and a second end portion on two opposite end portions of said bottom plate and having a squeezing chamber formed in said base;

a driving box secured on said base;

a squeezing means including a ratchet bar having ratchet teeth formed on said bar and reciprocatively held on said base and said driving box, having a piston member fixed on a first end portion of the ratchet bar and having a ratchet bar handle formed on a second end portion of said bar opposite to said piston member;

a lever means pivotally secured on said driving box having a first pawl pivotally secured on a lower portion of said lever means and normally engageable with said ratchet teeth of said ratchet bar, said first pawl operatively urging a ratchet tooth of said ratchet bar frontwardly towards said first end portion of said bottom plate and preventing a rearward retraction of said ratchet bar;

a second pawl engageable with said ratchet tooth of said ratchet bar preventing a rearward retraction of said ratchet bar;

said base including said bottom plate generally formed as rectangular shape having a plurality of fixing holes formed in the bottom plate for fixing the base on a wall by screws, a pair of longitudinal side walls longitudinally formed on two opposite sides of the bottom plate and protruding upwardly from the bottom plate, a holding plate portion secured with a holding platform formed on the first end portion of the bottom plate, a compression end plate formed on the first end portion of the bottom plate perpendicular to the bottom plate and adjacent to the holding platform having an upper extension of said compression end plate bent downwardly in a direction towards the second end portion of said bottom plate from said first end portion of said bottom plate for insertably retaining a can in the base, a retraction end plate formed on a second end portion of the bottom plate and secured with said driving box, said retraction end plate being opposite to the compression end plate and perpendicular to the bottom plate, and said squeezing chamber being confined by the bottom plate, the two side walls, the compression end plate and the retraction end plate; and said driving box including a box casing secured on said second end portion of the bottom plate and secured with the retraction end plate having a socket recessed in the casing, and a pair of bar holes longitudinally formed through the casing for reciprocatively engaging said ratchet bar in said two bar holes; whereby upon an upward pulling of said lever means to allow said first pawl to urge said ratchet bar frontwardly towards said first end portion of said bottom plate, said piston member will be pushed frontwardly to crush a can inserted in said squeezing chamber of said base means, and upon a lowering of said lever means, said first pawl will be slipped away from said ratchet teeth to be operatively re-engaged with another ratchet tooth ready for a next crushing operation.

2. A can crusher according claim 1, wherein said lever means includes a pivot fixed on the box casing of the driving box for pivotally securing a lower portion of the lever means on the box casing of the driving box, a first-pawl pin fixed on the lower portion of the lever means for pivotally securing the first pawl on the first-pawl pin and generally positioned besides a second-pawl pin secured on said box casing, a lever restoring spring having a lower spring end secured to a retaining hole formed in an retraction end plate formed on said base and having an upper spring end secured on a spring retaining pin secured on the lever means above the pivot of the lever means for normally tensioning the lever means downwardly towards the base ready for an upwardly pulling operation of the lever means, and a bifurcate arm member protruding outwardly from the lower portion of the lever means having a grip provided with elastomer packing on the grip secured on an outer end portion of the arm member; said first pawl normally restored downwardly for engaging said ratchet tooth of said ratchet bar by a first-pawl restoring spring.

3. A can crusher according to claim 2, wherein said second-pawl pin secured on said box casing of said driving box is provided for pivotally securing said second pawl on said second-pawl pin, said second pawl normally restored downwardly for engaging said ratchet tooth of said ratchet bar by a second-pawl restoring spring.

* * * * *